US006551228B1

(12) United States Patent
Richards

(10) Patent No.: US 6,551,228 B1
(45) Date of Patent: Apr. 22, 2003

(54) HIGH SPEED QUARTERFOLDER

(75) Inventor: John Sheridan Richards, Barrington, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 609 days.

(21) Appl. No.: 08/956,912

(22) Filed: Oct. 23, 1997

(51) Int. Cl.[7] ..... B42C 1/00; B42B 2/00; B65H 9/04; B31F 1/00

(52) U.S. Cl. ..... 493/417; 493/444; 271/245; 270/46; 270/52.14

(58) Field of Search ..... 493/417, 444, 493/445; 33/120; 271/245; 270/52.14, 46

(56) References Cited

U.S. PATENT DOCUMENTS 4,440,387 A * 4/1984 Ikoma et al. ..... 271/245
4,509,939 A 4/1985 Müller
4,549,728 A * 10/1985 Odeau ..... 270/46
4,746,107 A 5/1988 Schneider et al.
4,754,959 A 7/1988 Kobler et al.
4,985,013 A * 1/1991 Van Der Werff et al. ... 493/445
5,244,196 A * 9/1993 Walter et al. ..... 270/46
5,374,053 A * 12/1994 Doucet et al. ..... 271/245
5,458,557 A 10/1995 Bladie et al.

* cited by examiner

*Primary Examiner*—Lesley D. Morris
*Assistant Examiner*—Matthew Luby
(74) *Attorney, Agent, or Firm*—Kenyon & Kenyon

(57) ABSTRACT

A quarterfold folding device and method forms groupings of signatures in a signature product stream by delaying selected signatures during transport to a chopper mechanism, the chopper mechanism adapted to fold multiple signatures in a single chop, thereby increasing throughput of the quarterfold folding device and reducing the rate of operation of the chopper mechanism.

2 Claims, 7 Drawing Sheets

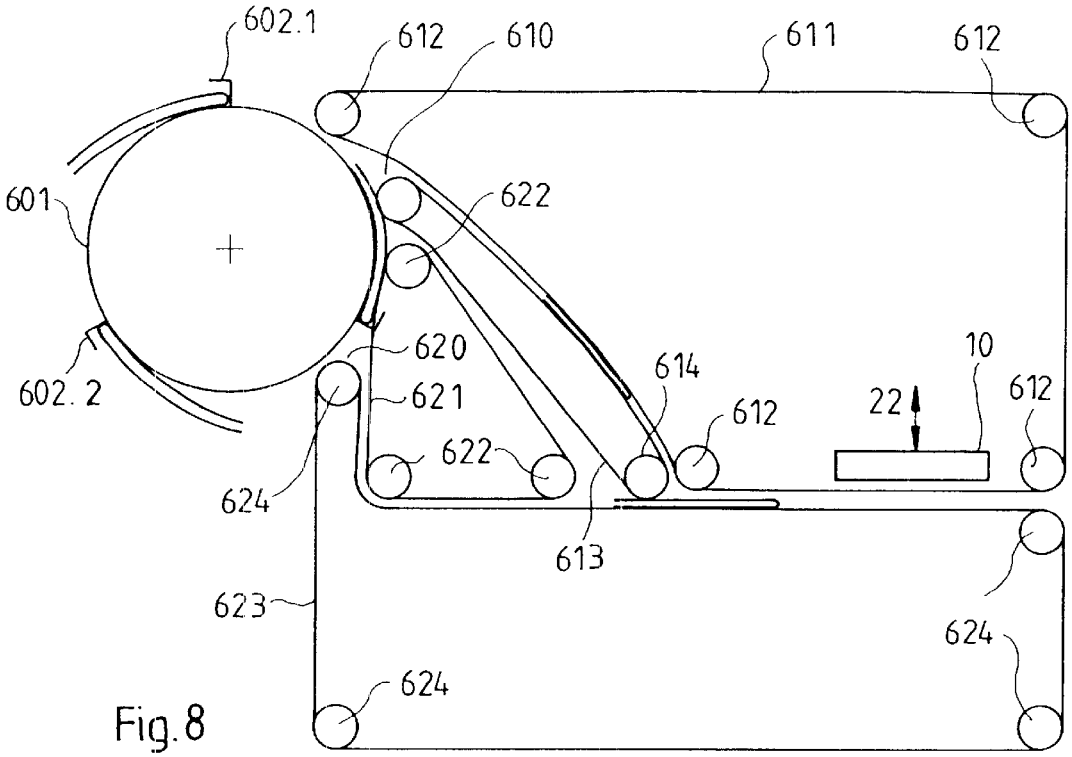
Fig. 8
Fig. 9
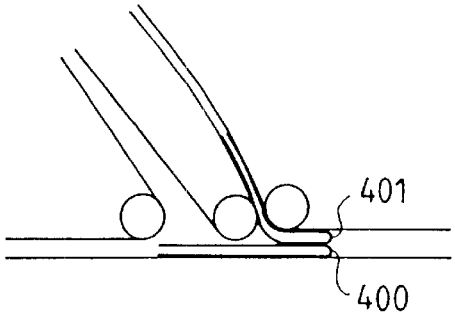

HIGH SPEED QUARTERFOLDER

FIELD OF THE INVENTION

The present invention relates to the field of printing presses and, in particular, to an apparatus for folding signatures in the folder section of a printing press.

BACKGROUND INFORMATION

The printing industry is continually increasing the speed at which printed copies can be generated. Printing, forming, folding and cutting operations are often done by a continuous operation machine, feeding in a web of blank paper from a roll and ending with a printed, cut and folded product, often referred to as a signature. For example, a web may pass through a series of processing units such as the print units, dryer, chill unit, folder and stacker, among others, in being processed into a finished product. One such processing unit in the folder is the quarterfolder.

Quarterfolding is typically defined as, for example, folding occurring in the web direction after the signature or sheet has been cut off from the web. The signature may also have been folded prior to quarterfolding. Typical quarterfolding is done, for example, by presenting signatures in sequence to a chopper mechanism that descends upon the signature, forcing it downward through a slot into awaiting rollers which fold the signature. Signatures typically are presented for quarterfolding at a 50% duty cycle, that is, there is a signature of a specific length followed by a space of approximately equal length before the next signature. Therefore, the chopper mechanism descends upon signatures which are presented one half of the cycle time.

Quarterfold mechanisms are known in the art. For example, U.S. Pat. No. 4,509,939, incorporated herein by reference, purportedly discloses a quarterfold folding device having a quarterfold blade arranged parallel to the direction of forward travel of a signature and intended to introduce the signature between two rotating cylinders parallel to the direction of forward travel, so as to form the longitudinal fold in the signature. The quarterfold folding device is purportedly suspended from two drive cranks which are rotationally driven parallel in the same direction and at the same speed by means of two additional rotating cranks, each of which is connected to one end of the drive cranks by means of a rotating pivot. The drive cranks carrying the quarterfold blade purportedly drive the quarterfold blade in a vertical movement between a bottom position and a top position. Signatures are purportedly fed into the quarterfold mechanism in a sequential and periodic manner corresponding to the period of the blades movement from the top position to the bottom position.

The process of quarterfolding is limited in speed, however, by the rates at which mechanisms and signatures can be treated with a 50% duty cycle as described above. To achieve higher speeds, two separate quarterfolders can be configured on one folder and, for example, arranged so that each quarterfolder folds alternating signatures. This approach adds costs and space requirements, however, that may be prohibitive to many smaller presses thereby limiting their potential speed.

SUMMARY OF THE INVENTION

It is an object of the present invention to provide a quarterfold folding device and method wherein selected signatures in a stream of signatures are delayed to form signature groupings, such as signature pairs, which are then folded via an appropriately sized chopper blade or folding blade, wherein the speed that the signatures are conveyed and the chopping rate can be varied as a result of forming the signature groupings.

Thus, the method and device according to the present invention achieves higher signature throughput by performing one quarterfold cycle for multiple signatures while using a single quarterfolder. Signatures are grouped into, for example, pairs and then the group of signatures is quarterfolded with an appropriate length single chopper blade, for example an extended length chopper blade. Thus, the quarterfolder according to the present invention can receive signature pairs at increased signature rates and at a 50% duty cycle, thereby increasing signature through-put. The device according to the present invention is usable in folders or sheeters performing a cross fold in a sheet or signature by a chopper mechanism.

The quarterfolding process according to the present invention involves delaying, for example, alternate signatures on their way to the quarterfolder, such that every other signature is moved back to create a smaller space behind it and a greater space ahead of it. This greater space allows a chopper mechanism to maintain, for example, a 50% duty cycle, while increasing the number of signatures that are quarterfolded in a given time or decreasing the chopping rate while quarterfolding the same number of signatures in a given time or some combination of both. The signatures that are simultaneously processed are paired by, for example, a delaying process. A suitable signature delaying mechanism may group the signatures as desired to prepare them for the quarterfolding process.

Thus, an exemplary embodiment of the present invention provides a chopper blade or quarterfold blade that is approximately twice the length of a single signature, wherein by controlling the feed rate at which the stream of signatures are fed to the quarterfold blade and delaying certain signatures, a grouping of signatures, for example, a pair, are quarterfolded simultaneously by a single blade without increasing the chopping rate of the blade.

The quarterfold folding device may also include a system for balancing the dynamic forces generated by the moving quarterfold blade as described in U.S. Pat. No. 5,458,557 entitled "Quarter-Fold Folding Device Having a Balancing System," which is incorporated in its entirety herein by reference.

The following description regarding the appended drawings, given by way of non-limiting examples, describes the present invention and how it can be produced.

BRIEF DESCRIPTION OF THE DRAWINGS

FIG. 8 is a side view of an alternate belt delay system according to the present invention.

FIG. 9 is a side view of a portion of the alternate belt delay system of FIG. 8 showing an alternate signature grouping.

DETAILED DESCRIPTION OF THE INVENTION

Figure 1:
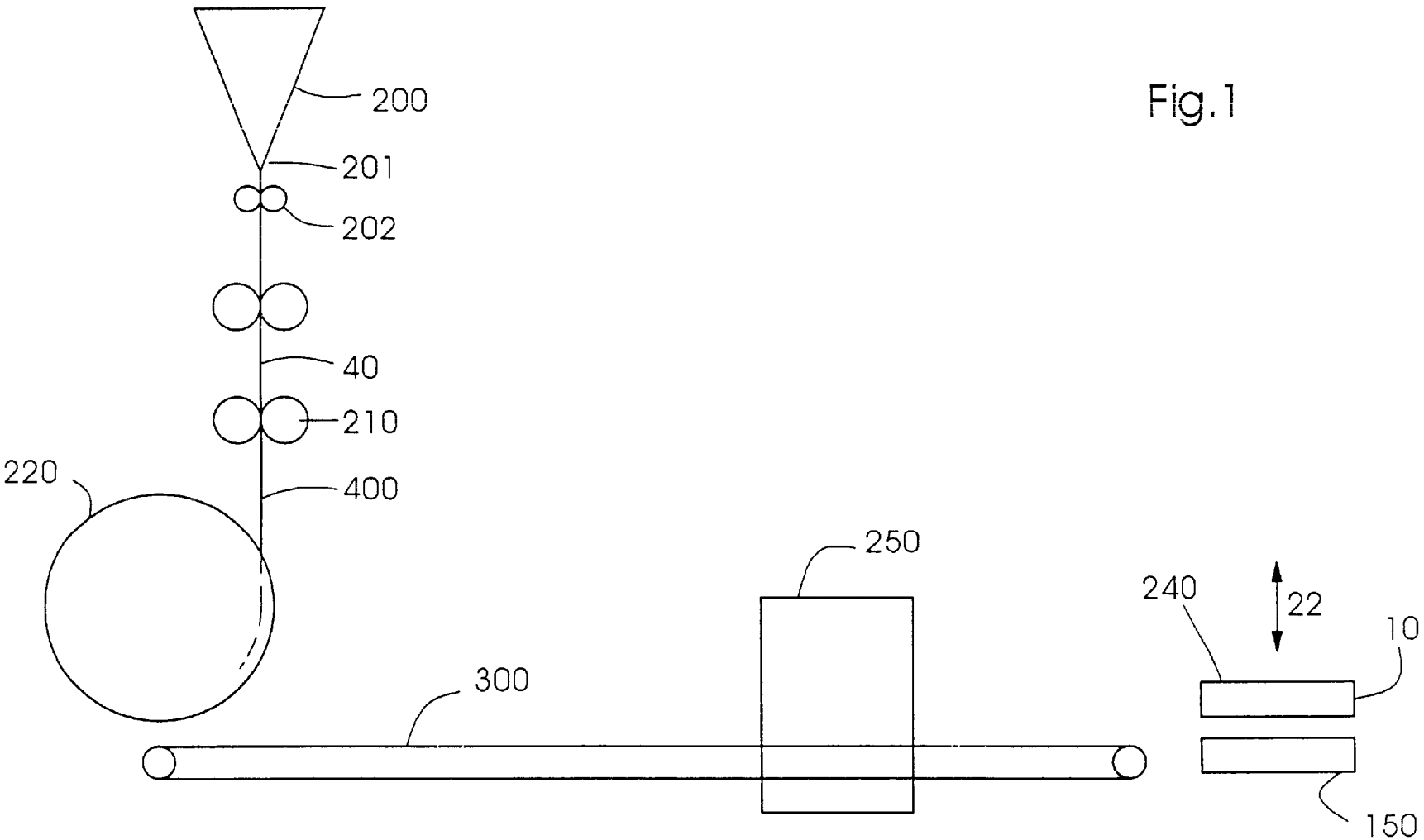
FIG. 1 is a plan view of a folder section of a printing press including a quarterfolder mechanism according to the present invention.

FIG. 1 shows a former section of a printing press including a web 40 or a configuration of several ribbons 40 one on top of the other, which may be fed over the former board 200 of a folder. The former board 200 is generally triangular in shape, having a width corresponding to the width of the ribbons fed onto the former board 200. The former board 200 narrows triangularly to a tip 201 at its downstream side. The former board 200 creates a longitudinal fold in the ribbons or web 40 roughly along the center-line of the ribbons or web 40 as they pass over the tip 201 of the former board 200. The ribbons or web 40 may traverse into nip rolls 202 below the former board 200. The ribbons or web 40 may be fed from the nip rolls 202 to cutting cylinders 210 so that the continuous ribbons or web 40 are cut into individual signatures 400.

Signatures 400 exiting from the cutting cylinders 210 may be decelerated by, for example, a fan wheel 220 and then placed on a conveyor 300 for further processing. Often, further processing of a signature 400 includes a quarterfolding operation wherein the signatures 400 are fed sequentially from the conveyor 300 into a quarterfolder 240 represented in FIG. 1 by a chopper blade 10 and a folding mechanism including, for example, cylinders 150 adapted to receive each signature 400 when the chopper blade 10 pushes the signature 400 down between the two cylinders 150. According to an embodiment of the present invention, a delay mechanism 250 may be disposed between the fan wheel 220 and the quarterfolder 240 in order to process signatures 400, as detailed below, prior to the quarterfolder 240.

Figure 2:
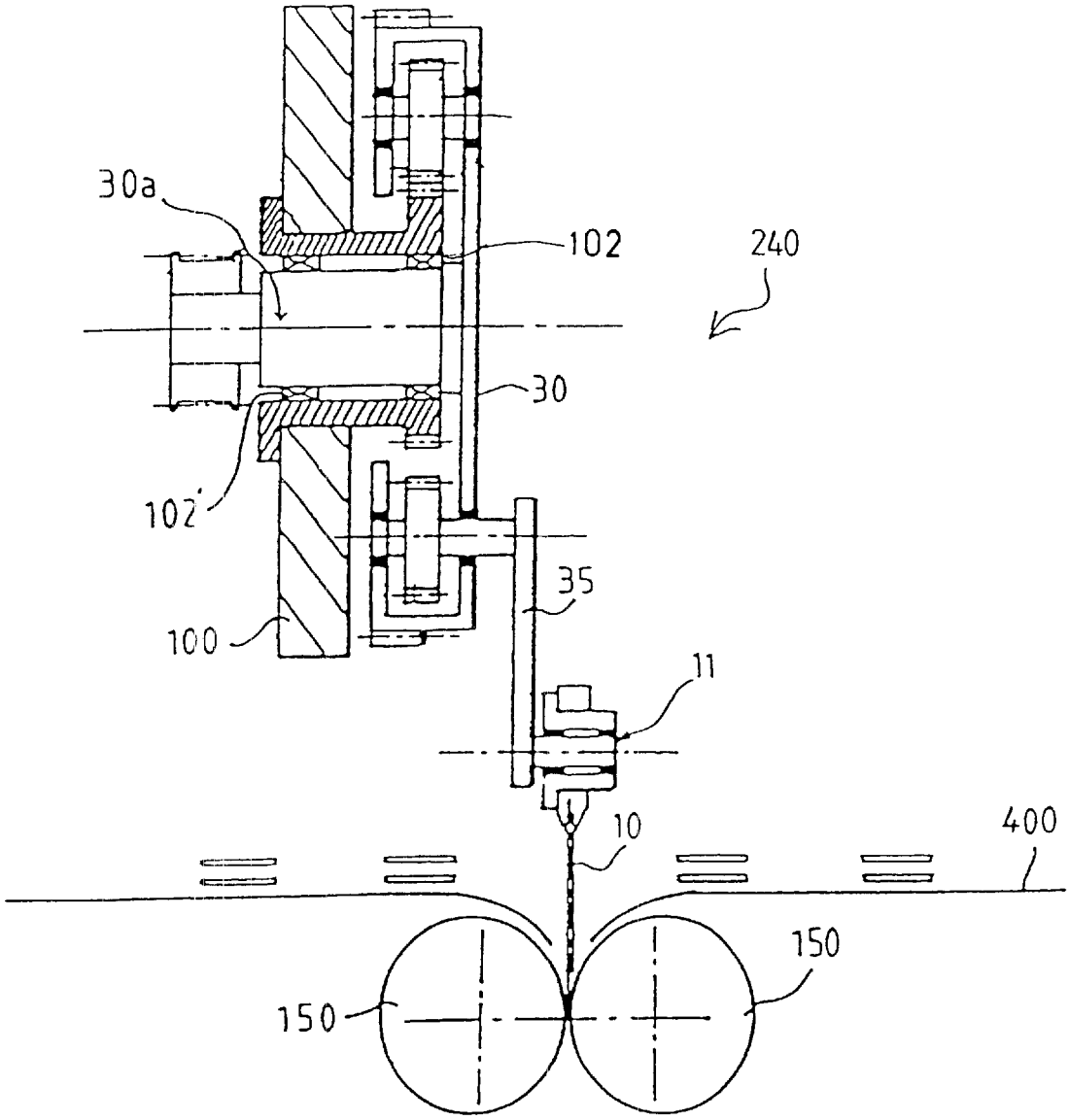
FIG. 2 is a partial side view in section along a vertical plane of the quarterfold folding device according to an embodiment of the present invention.
Figure 3:
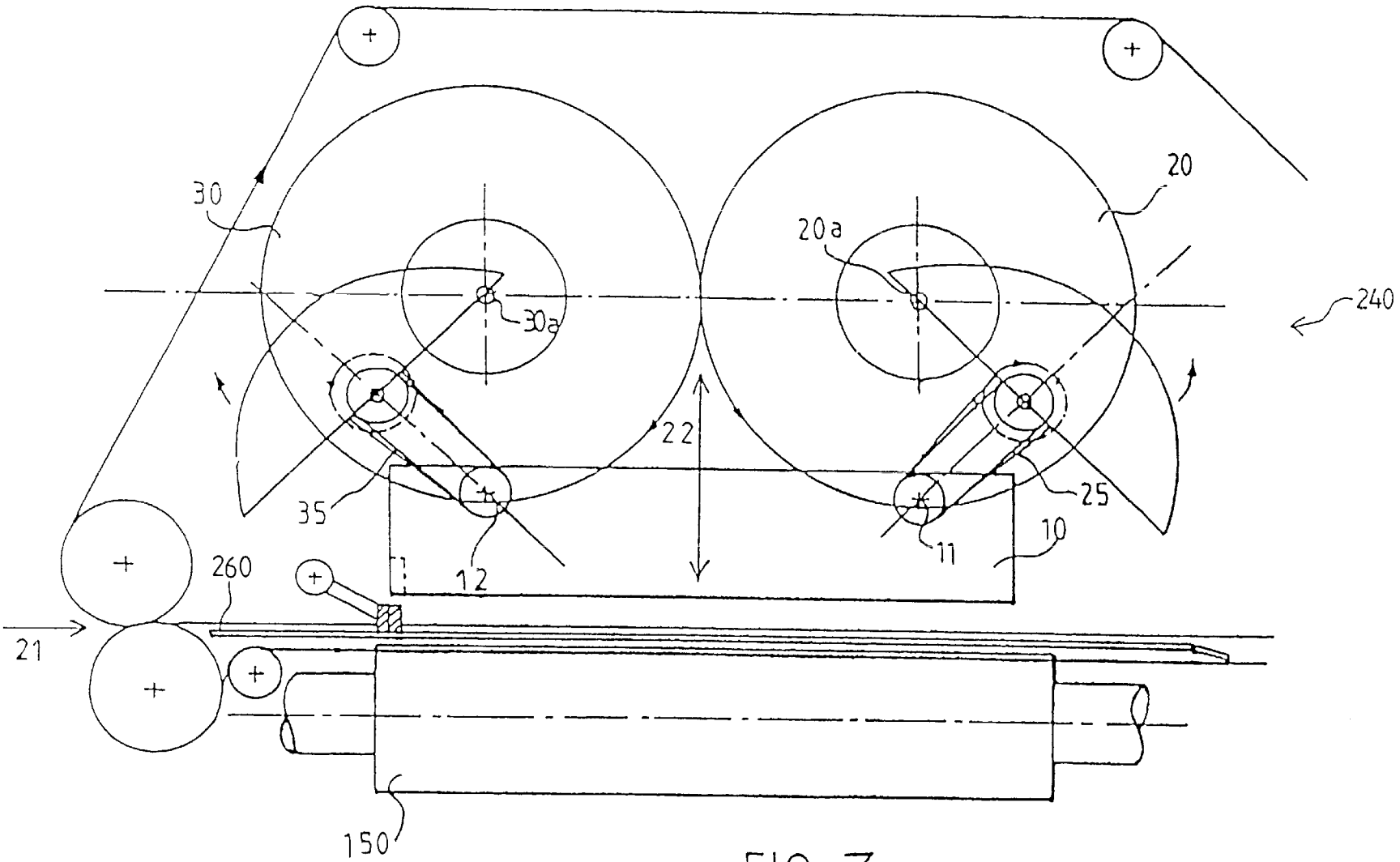
FIG. 3 is a front view of the quarterfold folding device of FIG. 2.

FIGS. 2 and 3 show an exemplary quarterfold folding device 240 for forming in a signature 400, or in a grouping such as a head-to-tail pairing of signatures 400, a longitudinal fold in the direction of forward travel (indicated by arrow 21 in FIG. 3) of the signature 400 in a horizontal plane. Quarterfolding devices are known in the art, and it should be understood that other conventional quarterfolding devices, such as described in U.S. Pat. No. 4,509,939, can be used in accordance with the present invention.

The folding device 240 comprises, for example, a vertical fixed framework 100 having two horizontal bearings, each situated at the same level, which include roller bearings 102, 102' in which two central rotating shafts 20*a*, 30*a* are mounted perpendicularly to the framework 100 and parallel to one another. The chopper blade 10 is linked by arm members 25 and 35 to rotating members 20 and 30 which rotate around shafts 20*a* and 30*a* respectively. The rotation of the rotating members 20 and 30 causes the chopper blade 10 to follow a reciprocating vertical path 22 that is used to effect the chopping function. When the chopper blade 10 is in a raised position, signatures 400 may move into place below the chopper blade 10. Then the chopper blade 10 may descend on the signatures to create the longitudinal fold therein via cylinders 150.

As shown in FIG. 3, the quarterfold blade or folding blade 10 is a horizontal blade, which is positioned parallel to the direction of forward travel 21 of the signature 400. Folding blade 10 is positioned above the signature 400, which is, for example, positioned on a folding table 260 having a folding slot that is parallel to the direction of forward travel 21 and faces the quarterfold blade 10. The quarterfold blade is rotatably attached to arm members 25 and 35 at pivot points 11 and 12 which are positioned on opposite sides of the quarterfold blade 10. The rotational motion of rotating members 20 and 30 translates into reciprocating vertical motion 22 of the folding blade 10.

The quarterfold device in accordance with the present invention includes a quarterfold blade 10 provided in a length suitable to quarterfold signature groupings such as two signatures arranged head-to-tail. Thus, for example, two signatures 400 may enter the quarterfold device 240 and be quarterfolded simultaneously by the quarterfold blade 10. Alternate groupings may be employed with correspondingly adjusted lengths of the quarterfold blade 10.

According to the present invention, signatures 400 are folded in a quarterfolding device in groups, such as two at a time, rather than individually as is typical in the art. Signatures 400 are typically delivered from, for example, cutting cylinders in a uniformly spaced arrangement. As described below, the feed rate of signatures 400 delivered from the upstream processes to the quarterfolding device of the present invention is typically altered in order to feed multiple signatures simultaneously into the quarterfold blade 10 while maintaining or decreasing the chopping speed of the blade 10.

Figure 4:
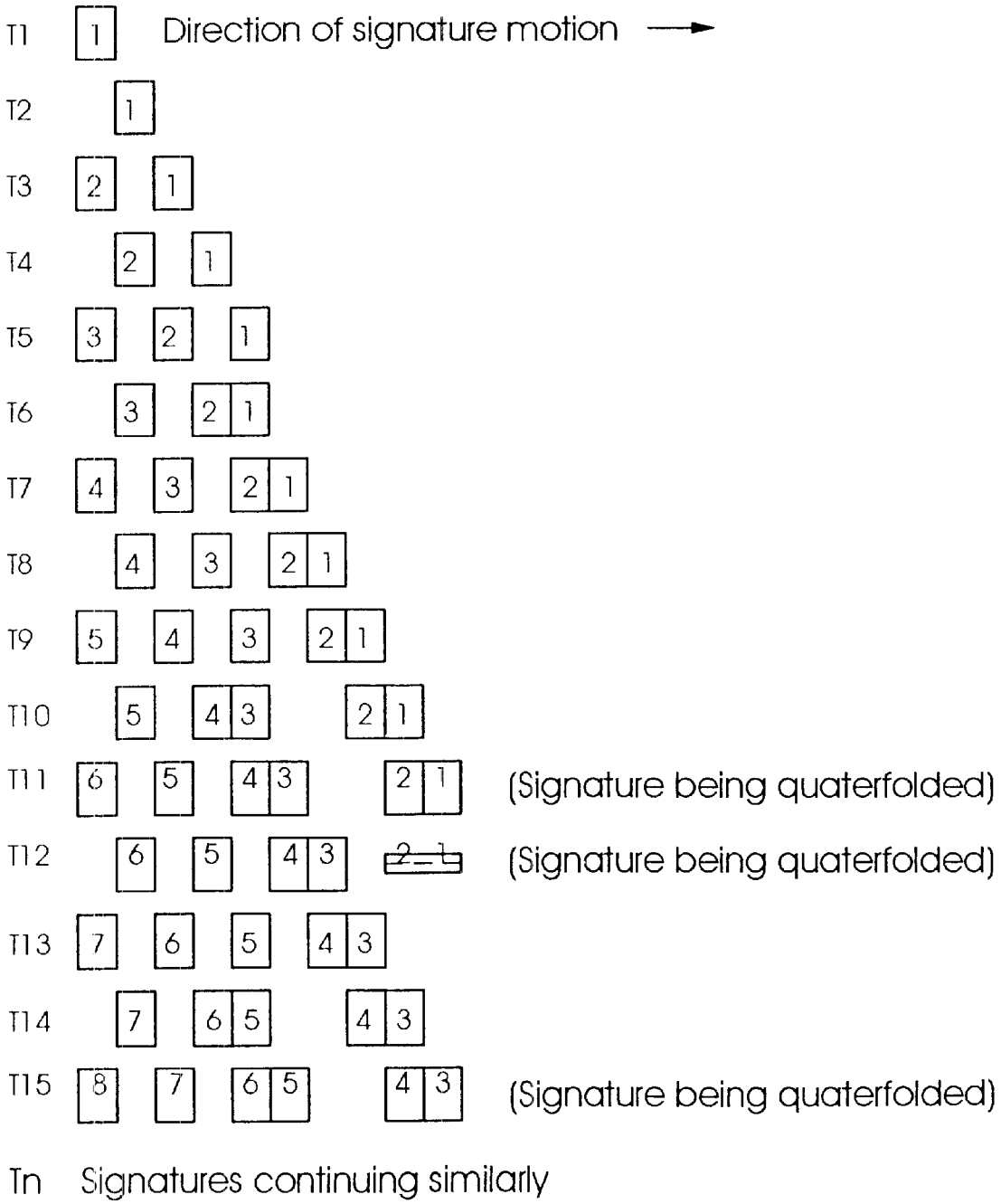
FIG. 4 is a schematic view of a stream of signatures being prepared for quarterfolding according to an embodiment of the present invention.

FIG. 4 shows an exemplary schematic of signature delivery according to an embodiment of the present invention showing, for example, fifteen snapshots in time. The positions of the signatures 400 as they are conveyed to the quarterfolder according to the present invention are shown for each time step. As shown in FIG. 4, initially the signatures 400 travel in a manner that provides a 50% duty cycle. For example signature 2, at time T3, has assumed the position that signature 1 occupied at time T1. The time interval T2 required for signatures 1 and 2 to advance gives rise to the 50% duty cycle. As illustrated, each signature 400 is followed by an approximately equal amount of empty space.

At time T5, three signatures 400 (numbered 1, 2 and 3) are still spaced at their original spacings. Between time T5 and T6, however, signature 1 is delayed according to the present invention, so that it forms a, for example, signature pair with signature 2. All signatures then proceed until time T9. Between times T9 and T10, however, signature 3 is delayed, forming another pair with signature 4. While signature pairs are being formed as shown in FIG. 4, it is also possible to create groupings of multiple signatures, such as groupings of three, by utilizing a second delay, to form, for example, signature group 1, 2 and 3 and group 4, 5 and 6, etc.

At time T10, the signature pairs 1–2 and 3–4 have been formed and are spaced, with one "pair" of spaces between the two pairs of signatures. At time T11, quarterfolding is beginning on pair 1–2, via the quarterfolder device 240 while pair 3–4 and individual signatures 5 and 6 continue to progress towards the chopper blade 10. At time T12, quarterfolding is about halfway completed on signature pair 1–2. At T13, the chopper blade 10 has raised up enough to clear the approach of signature pair 3–4 and thus signature flow can now continue, as represented by times T14, T15 and so on. Therefore, by incorporating a delay on selected signatures, such as delaying alternate signatures 400 to form signature pairs, e.g. signature pairs 1–2, 3–4, etc., signature pairs are created in which there is no empty space, or minimal space, between the signatures 400 in each signature pair. For example, signatures 1 and 2 form a pair with substantially no space between them, as does signature pair 3–4, signature pair 5–6, and so on. The signature pairs are each presented to the quarterfolding device of the present invention to be simultaneously quarterfolded.

Accordingly, by delaying selected signatures 400 to form signature groupings such as signature pairs, several advantages are achieved. For example, if the feed rate of the signatures 400 to the quarterfolder 240 is maintained and selected signatures 400 are delayed into signature pairs, the chopping rate of the chopper blade according to the present invention can be reduced by 50% while maintaining the same throughput as a single-signature chopper blade as known in the prior art. This follows because signature pairs arrive at the chopper blade 10 at half the frequency that individual signatures 400 (before delay) would be presented for individual folding by the chopper blade 10. Alternatively, the chopping rate of the chopper blade 10 can be maintained or partially reduced when accompanied by a corresponding increase in the feed rate of the signatures 400.

For example, if the chopping rate of the chopper blade 10 is maintained and signature pairs are generated via a delay mechanism according to the present invention, the feed rate of the signatures 400 may be doubled, thereby doubling the throughput of the quarterfolding device 240. In such a case, the quarterfolding device 240 maintains a 50% duty cycle, (that is, the lengths of signature pairs are followed be equal lengths of spacing between signature pairs). Indeed, according to the present invention, any combination of feed rate increase for signatures 400 and corresponding reduction in chopping rate of the chopper blade 10 can be achieved as a result of delaying selected signatures 400 to form a signature grouping to be folded in a single chop. For example, an increase in feed rate from 100% to 150% would be accompanied by a chopping rate reduction from 100% to 75% when operating the chopper blade 10 with a 50% duty cycle. It is also possible to deliver signatures at other than a 50% duty cycle by such means as altering the speeds of all signatures. For example, a signature stream having a signature pair followed by an empty space the length of a single signature has a 67% duty cycle. In such a case, the chopper blade 10 folds two signatures 400 during one third of a cycle, then delays for two thirds of the cycle while two more signatures 400 (i.e., a signature pair) move into position under the chopper blade 10.

Figure 5:
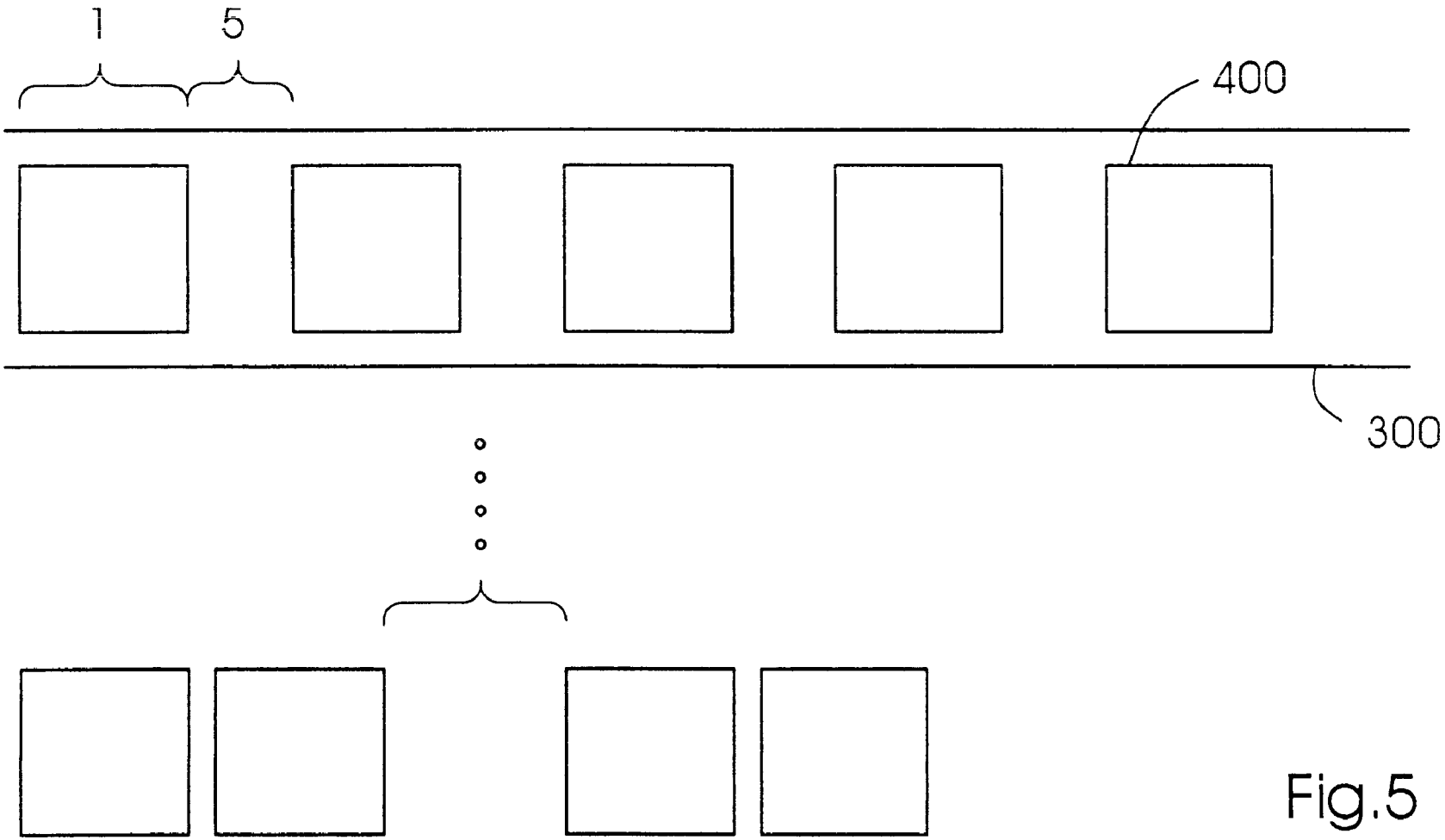
FIG. 5 shows a signature stream adapted to a 67% duty cycle.

FIG. 5 shows a signature stream that may be adapted to, for example a 67% duty cycle. A fan wheel or deceleration drum 220 delivers signatures 400 to, for example, a conveyor belt 300 with half a signature length between adjacent signatures 400. Delaying every other signature 400 for half a signature length produces signature pairs having a single-signature space between them. This defines a 67% duty cycle as a cycle in which two thirds of the cycle contains signatures to be processed and one third of the cycle is blank space.

In this case, a chopper blade 10 may be constructed, for example, to complete the chopping process in less than 50% of the available cycle, using cycloidal motion, as is well known in the art. Thus, for example, the conveyor belt 300 may transport a signature pair into position under the chopper blade 10 during the two thirds of the cycle that the blade is above the signature, while the folding occurs during the remaining one third of the cycle while a succeeding signature pair approaches the chopper blade 10.

As indicated above, processing a stream of signatures 400 in the quarterfolding device according to the present invention includes delaying selected signatures 400 via, for example, a delay mechanism 250 (see FIG. 1) located upstream of the quarterfold device 240. Any choice from a number of suitable delay mechanisms may be employed. For example, one way of delaying a signature 400 involves creating an "on-belt" delay. In an on-belt delay, for example, a signature 400 is delayed while it is on the belt progressing toward the chopper blade 10 of the quarterfolder 240. Alternate signatures 400 may be delayed by, for example, stopping them and then restarting them as they proceed along a belt toward the quarterfolder. Similarly, the delay of more than two signatures 400 can also be achieved.

Figure 6:
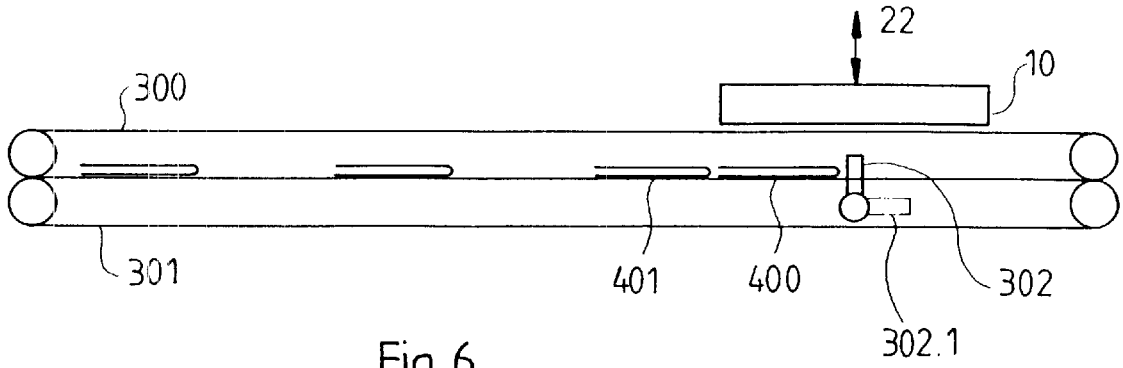
FIG. 6 is a side view of an exemplary on-belt delay mechanism according to the present invention.

FIG. 6 shows an exemplary on-belt delay mechanism. Conveyor belts 300 and 301 are situated downstream of and receive signatures 400 from, for example, a fan wheel or deceleration device (not shown). The conveyor belts 300 and 301 deliver the signatures 400 to a quarterfolding chopper blade 10 downstream of the conveyor belts. A headstop 302 is located on the conveyor belts 300 and 301 at an appropriate intermediate point between the upstream device, e.g., the fanwheel or deceleration drum 220 (see FIG. 1) and the downstream device, e.g., the quarterfolding device 240. The headstop 302 may, for example, be a pivotally mounted member that pivots between a raised position 302.1 and a lowered position 302.2. In the raised position 302.1, the headstop 302 impedes the forward progress of the signature 400 in order to delay it until it is substantially adjacent to the succeeding signature 401. The headstop 302 can then pivot to the lowered position 302.2 to thereby no longer impede the progress of the signature 400 and allowing signatures 400, 401 to proceed as a signature pair. Appropriate timing of the pivoting of the headstop 302 provides for the creation of pairs of signatures 400 being delivered to the quarterfold blade 10 in accordance with the present invention.

Other means of on-belt delays, different from the headstop mechanism shown in FIG. 6, may also be employed. For example, tail grabbers or other devices known in the art may be used to delay or control signatures 400 in order to provide for different spacing schemes between the signatures 400, such as the head-to-tail arrangement, a grouping of three signatures, or the "mama-papa" configuration, in which two signatures, one on top of the other, are folded such that one signature 400 is folded within the other. Gripping mechanisms that grip the tail of a signature 400, or that grip a point intermediate to the head and the tail of a signature 400, in order to delay the signature 400 on, for example a conveyor, may also be employed to create the signature groupings for delivery to the quarterfold blade 10.

Figure 7:
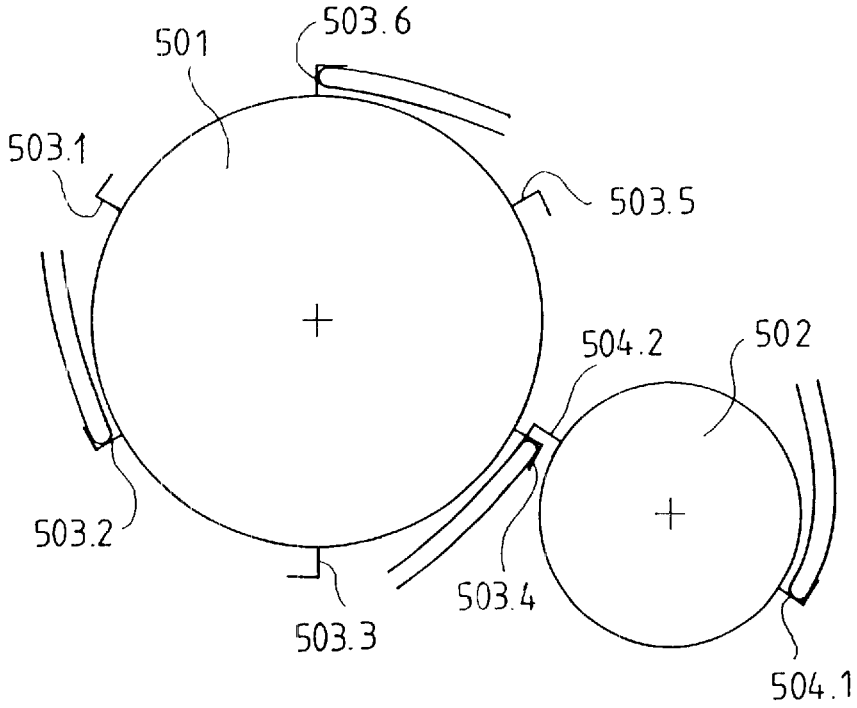
FIG. 7 is a side view of a cylinder delay mechanism according to the present invention.

FIG. 7 shows another delay mechanism according to an embodiment of the present invention, referred to as a cylinder delay. As illustrated in FIG. 9, a first cylinder 501 has multiple grippers 503 (e.g., 503.1–503.6) spaced about its circumference. Cylinder 501 is located adjacent to, for example, a conveyor belt 300. The grippers 503 may grip signatures 400 from the conveyor belt 300 via a conventional gripping mechanism as is known in the art. A second cylinder 502, for example being a different diameter from the first cylinder 501, also has multiple grippers 504 (e.g., 504.1–504.2) spaced about its circumference. The second cylinder 502 is disposed, for example, substantially parallel to the first cylinder 501 with a center to center distance that permits the grippers 503 of the first cylinder 501 and the grippers 504 of the second cylinder 502 to interact. The two cylinders 501, 502 may be equipped with grippers 503, 504 as are known in the art that are capable of transferring signatures 400 from one cylinder to the other or from a cylinder to a conveyor belt.

In operation, the first cylinder 501, which receives signatures 400 from upstream processing units as is known in the folder art, passes a signature 400 from, for example, gripper 503.1 to gripper 504.1 of the second cylinder 502. The circumferences of the cylinders 501, 502 are sized proportionately such that, for example, the grippers 503 of the first cylinder 501 interact with a different gripper 504 from the second cylinder 502 on successive rotations using one of the gripper-to-gripper transfer methods known in the art. Thus, the second cylinder 502 may then pass the signature 400 from gripper 504.1 to gripper 503.2 of the first cylinder 502. The first cylinder 501 may then deposit two signatures onto the conveyor 300 in a head-to-tail configuration, that is, substantially without space between the head of one signatures 400 and the tail of the prior signature 400. The signatures 400 thus enter the quarterfolding device 240 for simultaneous quarterfolding according to the present invention.

The first cylinder 501 or the second cylinder 502 may also, for example, have a small but rotating eccentricity, such that when a signature is transferred from one cylinder to the other, the gripper on the cylinder to which the signature is being transferred is moving more quickly than the gripper on the cylinder from which the signature is being taken. For example, in transferring the signature from gripper 503.4 to gripper 504.2, gripper 504.2 will move slightly faster than gripper 503.4.

FIG. 8 shows an alternate belt delay system according to the present invention which can be used to release, for example, every other signature 400 in a signature product stream into alternate belt systems having different path lengths to the quarterfolder. The embodiment of FIG. 8 shows a conventional folding cylinder 601 arranged substantially perpendicular to the signature path for receiving signatures from upstream processing units of the press. The cylinder 601 has multiple grippers 602.1–602.2 distributed around its circumference. Adjacent to the cylinder 601 are two belt paths 610 and 620. Belt path 610 is formed by belt 611 which traverses around rollers 612 and belt 613 which traverses around rollers 614. A second belt path 620 is formed by belt 621 which traverses around rollers 622 and belt 623 which traverses around rollers 624. The belt paths 610 and 620 eventually join together. For example, in the embodiment shown in FIG. 8, belt 610 and belt 620 form a third belt path designated by reference numeral 630 that leads to a chopper blade 10 for quarterfolding. Alternatively, the belt paths 610 and 620 could deposit signatures 400 onto an independent conveyor (not shown) disposed immediately downstream of the belt paths 610 and 620. The independent conveyor could then transport the signatures to the chopper blade 10.

In operation, the alternate belt delay system shown in FIG. 8 provides signatures 400 in a head-to-tail configuration by, for example, delivering alternate signatures 400 to alternate belt paths. Gripper 602.1 releases a first signature 401 into the first belt path 610. Subsequently, gripper 602.2 releases a second signature 402 into the second belt path 620. The length and speed of the belt paths are synchronized to deliver the signatures 401 and 402 to the combined belt path 630 in a head-to-tail pairing. The signature pair 401, 402 is then transported to the chopper blade 10, which follows a reciprocating vertical path 22, for quarterfolding.

FIG. 9 shows an alternate delivery of signatures 400 through the alternate tape paths. In this embodiment, the signatures 400 and 401 are delivered to the combined belt path 630 one on top of the other rather than head-to-tail. This is advantageous for quarterfolding two signatures wherein the signatures are folded with one inside the other, also known as a "mama-papa" configuration. The mama-papa configuration may be achieved by other delay mechanisms such as those discussed above.

Other techniques of delaying a signature may be envisioned which are within the spirit and scope of the present invention.

The throughput of a printing machine may be further enhanced by, for example, splitting a stream of signatures 400, either before or after creating groupings of signatures 400, as discussed above, and processing each of the split streams in a separate folding device 240 according to the present invention. Thus, the quarterfolder rate can be, for example, quadrupled by splitting the signature stream and providing a signature pair grouping from each stream to separate chopper blade 10 while operating each of the two chopper blades 10 at the pre-delay chopping rate.

What is claimed is:

1. A device for forming a longitudinal fold in signatures being conveyed by a conveyor system, comprising:

a delay mechanism selectively processing individual signatures from a stream of signatures to form at least one signature grouping, a folding blade disposed downstream of the delay mechanism and parallel to a direction of forward travel of the at least one signature grouping; and a folding mechanism disposed below the folding blade, the folding mechanism receiving each signature of the at least one signature grouping and longitudinally folding all the signatures of the at least one signature grouping simultaneously, wherein the folding blade is driven between a first position and a second position, the folding blade in the second position urging the signatures of the at least one signature grouping toward the folding mechanism, wherein the at least one signature grouping operated upon by the folding blade includes a head-to-tail pairing of two adjacent signatures.

2. A device for forming a longitudinal fold in signatures being conveyed by a conveyor system, comprising:

a delay mechanism selectively processing individual signatures from a stream of signatures to form at least one signature grouping, a folding blade disposed downstream of the delay mechanism and parallel to a direction of forward travel of the at least one signature grouping; and a folding mechanism disposed below the folding blade, the folding mechanism receiving each signature of the at least one signature grouping and longitudinally folding all the signatures of the at least one signature grouping simultaneously, wherein the folding blade is driven between a first position and a second position, the folding blade in the second position urging the signatures of the at least one signature grouping toward the folding mechanism, wherein the delay mechanism comprises a headstop disposed on the conveyor system, the headstop being movable between a first position and a second position, the first position impeding a forward motion of at least one of the signatures and the second position not impeding the forward motion of at least one of the signatures.

* * * * *